US005205455A

United States Patent [19]

Moody

[11] Patent Number: 5,205,455

[45] Date of Patent: Apr. 27, 1993

[54] DISPENSER WITH STABILIZER FOR CORELESS ROLL PRODUCTS

[75] Inventor: John R. Moody, Antioch, Calif.

[73] Assignee: James River II, Inc., Oakland, Calif.

[21] Appl. No.: 886,592

[22] Filed: May 21, 1992

[51] Int. Cl.[5] ..... A47K 10/32; B65D 85/671

[52] U.S. Cl. ..... 225/106; 206/409; 221/51; 221/63

[58] Field of Search ..... 221/46, 63, 51; 225/106; 206/390, 408, 409, 812

[56] References Cited

U.S. PATENT DOCUMENTS

| | | | |
|---|---|---|---|
| 3,038,598 | 6/1962 | Layton et al. . | |
| 3,089,659 | 5/1963 | Perrin . | |
| 3,150,808 | 9/1964 | Vensel | 225/106 |
| 3,282,525 | 11/1966 | Rehr . | |
| 4,013,240 | 3/1977 | Perrin | 242/55.53 |
| 4,171,047 | 10/1979 | Doyle et al. | 225/106 X |
| 4,262,816 | 4/1981 | Margulies | 221/46 |
| 4,431,141 | 2/1984 | Schutz | 242/56.2 |
| 4,694,973 | 9/1987 | Rose et al. | 221/46 |
| 4,905,868 | 3/1990 | Beane et al. | 221/46 X |
| 4,951,891 | 8/1990 | Kozbur et al. | 242/56.2 |
| 4,974,783 | 12/1990 | Campbell | 242/55.53 |
| 5,028,097 | 7/1991 | Tucker | 312/38 |

*Primary Examiner*—Frank T. Yost
*Assistant Examiner*—Rinaldi Rada
*Attorney, Agent, or Firm*—Thomas R. Lampe

[57] ABSTRACT

A center-pull dispenser housing has a top and a support, the support defining a dispensing aperture. A coreless roll of sheet material is disposed on the support with the lead end of the sheet material extending from the coreless roll center through the dispensing aperture. The coreless roll has either channels or projections formed at the ends thereof which cooperate with stabilizing elements on the housing to resist movement of the coreless roll and collapse of the coreless roll as it nears depletion.

10 Claims, 1 Drawing Sheet

DISPENSER WITH STABILIZER FOR CORELESS ROLL PRODUCTS

TECHNICAL FIELD

This invention relates to a dispenser system for dispensing sheet material from a coreless roll. The invention has particular application to the dispensing of paper toweling and the like from a "center-pull" dispenser. The roll is stabilized during dispensing and collapse of the coreless roll is resisted as it nears depletion.

BACKGROUND ART

It is well known in the prior art to dispense paper toweling, tissue, and similar products from the center of a coreless roll thereof. For example, U.S. Pat. No. 4,905,868, issued Mar. 6, 1990, discloses a paper towel dispenser of the "center-pull" type wherein paper toweling is dispensed from the center of a coreless roll by pulling same through a dispenser nozzle of a specific character.

Several problems arise when attempting to dispense from free standing coreless rolls of paper toweling or the like. For example, coreless rolls of paper toweling have a tendency to collapse as they near depletion due to dispensing. This can interfere with proper dispensing of the remaining material. In addition, it is necessary, or at least desirable, to maintain the roll in a fixed position relative to the dispensing opening of the dispenser to ensure proper operation. If a roll is dislodged from such position, as for example by a too vigorous pull being exerted on the sheet material being dispensed, proper operation can also be interfered with.

The prior art discloses a number of arrangements for supporting and stabilizing rolls of paper toweling and the like within dispenser cabinets. Believed representative of such arrangements are the systems shown in U.S. Pat. No. 5,028,097, issued Jul. 2, 1991, U.S. Pat. No. 4,974,783, issued Dec. 4, 1990, U.S. Pat. No. 3,089,659, issued May 14, 1963, U.S. Pat. No. 3,038,598, issued Jun. 13, 1962, and U.S. Pat. No. 4,013,240, issued Mar. 22, 1977. The arrangements disclosed in the patents just noted all are specifically adapted for use when dispensing paper toweling and the like from rolls having cores and which deliver sheet material from the outer peripheries of the rolls during rotation within the dispensing cabinet. Such arrangements are inapplicable to the dispensing of sheet material from the center of a coreless roll which remains stationary within a dispenser and is positioned on end.

When practicing the teachings of the present invention the coreless roll includes channels and/or projections at the coreless roll ends which cooperate in a specific manner with stabilizing means to accomplish the desired results of maintaining the coreless roll in a predetermined position and for resisting collapse of the coreless roll when it nears depletion. U.S. patents are in existence which disclose rolls of toweling and the like which incorporate a core and have grooves and/or bosses as well as equipment and methods for forming same. There is no teaching, however, of employing such expedients on a coreless roll and it will be appreciated that quite different considerations are involved when dispensing from the center of stationary coreless rolls as compared to rotatable rolls employing center cores. Applicant is aware of the following U.S. patents relating to rolls with cores and having grooves and/or bosses, as well as systems for manufacturing same: U.S. Pat. No. 3,282,525, issued Nov. 1, 1966, U.S. Pat. No. 4,951,891, issued Aug. 28, 1990, and U.S. Pat. No. 4,431,141, issued Feb. 14, 1984.

DISCLOSURE OF INVENTION

The present invention relates to a system for inexpensively, efficiently, and effectively maintaining a coreless roll of sheet material in a predetermined position relative to a dispensing aperture and for resisting collapse of the coreless roll when the coreless roll nears depletion caused by dispensing of the sheet material through the dispensing aperture.

The dispenser apparatus of the present invention is for dispensing sheet material from the center of a coreless roll of the sheet material having a first end and an opposed second end.

The dispenser apparatus includes housing means defining an interior and including a support engageable by the coreless roll first end to support the coreless roll of sheet material. The support defines a dispensing aperture through which sheet material from the coreless roll is pulled when dispensing the sheet material from the center of the roll.

Stabilizing means is provided for maintaining the coreless roll in a predetermined position relative to the dispensing aperture when the coreless roll is supported by the support means. In addition, the stabilizing means is for resisting collapse of the coreless roll when the coreless roll nears depletion caused by dispensing of the sheet material through the dispensing aperture.

At least the coreless roll first end has a planar portion formed by edges of a first plurality of convolutions of sheet material and an offset portion defined by edges of a second plurality of sheet material convolutions offset from the edges of the first plurality of convolutions. The stabilizing means includes at least one stabilizing element at least partially registrable with the offset portion and cooperable therewith to resist movement of the coreless roll relative to the dispensing aperture.

According to one embodiment of the invention, the stabilizing element comprises a rib projecting upwardly from the support and the coreless roll offset portion comprises a channel, the rib being received in the channel when the support engages the coreless roll first end and supports the coreless roll.

In another embodiment constructed in accordance with the teachings of the present invention, the stabilizing element comprises a recess formed in the support, the coreless roll offset portion comprising a projecting extending outwardly from the coreless roll planar portion and received within the recess when the support engages the coreless roll first end and supports the coreless roll.

Other features, advantages, and objects of the present invention will become apparent with reference to the following description and accompanying drawings.

MODES FOR CARRYING OUT THE INVENTION

Figure 2:
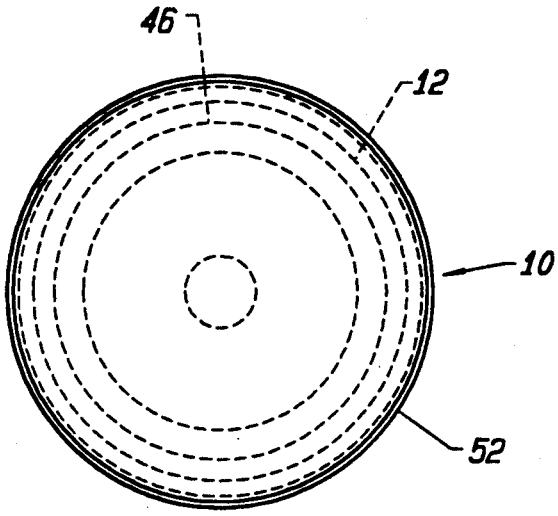
FIG. 2 is a top, plan view of the dispenser apparatus of FIG. 1.
Figure 1:
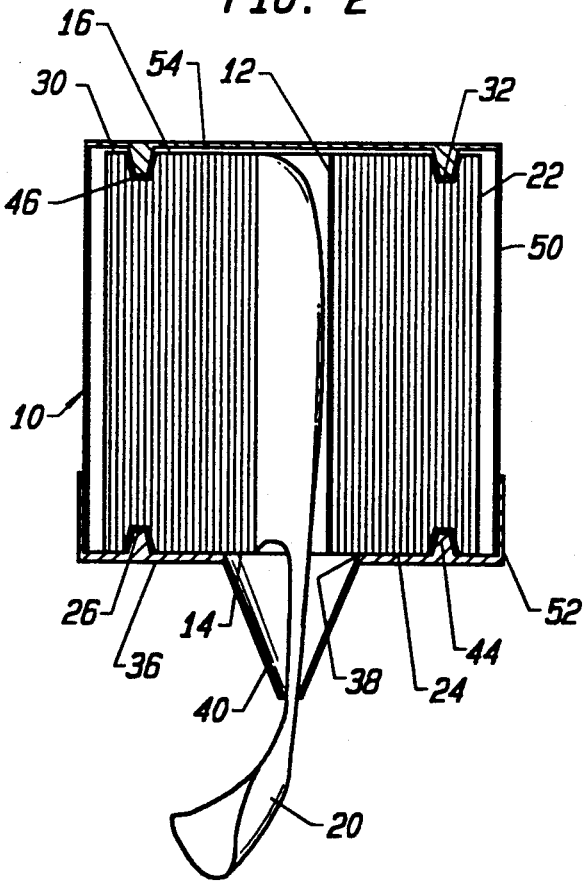
FIG. 1 is a cross-sectional, elevational view of dispenser apparatus constructed in accordance with the teachings of the present invention accommodating therein a coreless roll constructed in accordance with the teachings of the present invention.

Referring now to FIGS. 1 and 2, dispenser apparatus constructed in accordance with the teachings of the present invention is illustrated. The dispenser apparatus includes a housing 10 defining an interior accommodating a coreless roll 12 of sheet material. For purposes of illustration, the sheet material is paper toweling; however, it is to be understood that the teachings of the present invention are applicable to other types of sheet material, such as paper tissue.

Coreless roll 12 has a first end 14 and an opposed second end 16. The roll has a lead end 20 which projects from the center of the coreless roll and a tail end 22 comprising all or a portion of the outer convolution of the roll.

First end 14 of the coreless roll has a planar portion 24 formed by edges of a first plurality of convolutions of the toweling and an offset portion 26 defined by edges of a second plurality of sheet material convolutions offset from the edges of the first plurality of convolutions. Offset portion 26 is in the form of a circular-shaped channel surrounding the center of the roll and located closely adjacent to the outer periphery thereof.

Coreless roll second end 16 also has a planar portion 30 formed by edges of a first plurality of convolutions and an offset portion 32 defined by edges of a second plurality of sheet material convolutions offset from the edges of the first plurality of convolutions. The offset portion 32 is in the form of a circular-shaped channel surrounding the center of the coreless roll and located closely adjacent to the outer periphery of the coreless roll. In the arrangement illustrated, offset portions 26, 32 are in alignment. While this is a preferred approach, such relationship is not necessary in order to practice the teachings of the present invention.

The offset portions or channels 26, 32 may be formed in any desired manner. For example, the offset portions 32 may be formed by cutting them with a suitable cutter blade or tool after the roll has been formed or by utilizing a slitter-groover technique during formation of the roll such as that taught by U.S. Pat. No. 4,951,891, referenced above.

In the arrangement of FIGS. 1 and 2, the housing includes a support 36 which is a bottom wall having a circular configuration. The support defines a dispensing aperture 38 through which toweling from the coreless roll 12 is pulled when dispensing the toweling from the center of the roll. In the arrangement shown, dispensing aperture 38 leads to the passageway of a cone-like element 40 which defines a restricted opening at the distal end thereof through which the toweling is pulled. The element 40 exerts a frictional restraining force on the toweling, enabling the user to sever individual towels of the toweling along perforated lines formed in the toweling, in the well known manner. Of course, roll 12 need not be perforated in order to practice the teachings of the present invention.

A circular rib 44 projects upwardly from support 36 and such rib conforms substantially to the shape of the offset portion 26 and location thereof. Likewise, a rib 46 projects downwardly from the top of the housing and enters offset portion 32.

Ribs 44, 46 are stabilizing elements which maintain coreless roll 12 in a predetermined fixed position relative to the dispensing aperture 38 when the coreless roll is supported by support 36. The ribs also cooperate with the roll to resist collapse of the roll when it nears completion caused by dispensing of the sheet material through the dispensing aperture. Such collapse would normally occur when dispensing of the toweling leaves only a relatively few convolutions adjacent to the outer periphery of the roll.

Housing 10 includes two separable housing components 50, 52 which may readily be separated or assembled, as desired, so that a new coreless roll may be positioned in the housing interior upon depletion of its predecessor roll. Housing component 50 includes the top or upper wall 54 from which rib 46 projects and housing component 52 includes support 36 as well as an upstanding flange for receiving the side wall of housing component 50.

Figure 3:
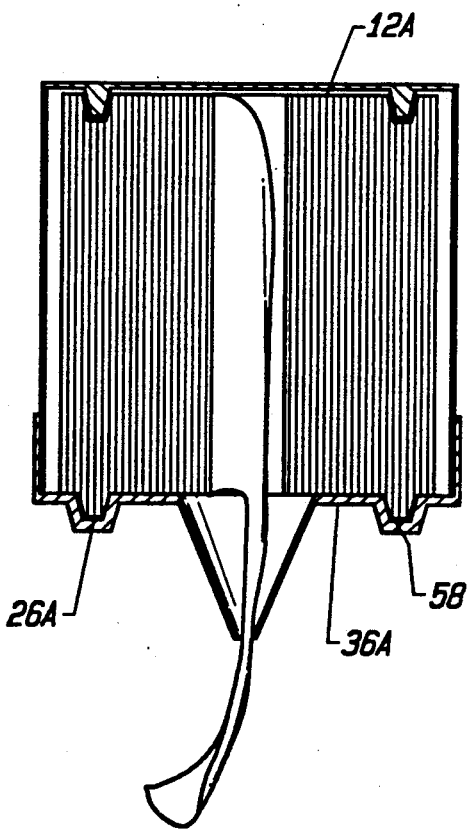
FIG. 3 is a view similar to FIG. 1, but illustrating an alternative form of dispenser apparatus in combination with an alternative form of coreless roll.

The dispensing apparatus and associated coreless roll shown in FIG. 3 differ somewhat from those structural elements illustrated in FIGS. 1 and 2. More particularly, in the FIG. 3 embodiment, the coreless roll 12A has an offset portion in the form of a channel only at one end (the upper end) of the roll. The offset portion 26A of roll 12A is in the form of a circular projection surrounding the center of the roll and located closely adjacent to the outer periphery of coreless roll 12A.

The support 36A of the housing defines a circular recess 58. Projection or offset portion 26A extending outwardly from the coreless roll planar portion is received within recess 58 when the support 36A engages the coreless roll first end and supports the coreless roll. Thus, as was the case with respect to the first embodiment of FIGS. 1 and 2, this embodiment of the invention provides stability for the coreless roll at both the upper and lower ends thereof.

Other variations are possible. For example, the roll offset portions may both comprise projections and the stabilizing elements may comprise recesses in both the housing top and housing support.

I claim:

1. Dispenser apparatus for dispensing sheet material from the center of a coreless roll of said sheet material, said coreless roll being formed from convolutions of said sheet material having spaced first and second edges, and said coreless roll having a first end defined by the first edges and an opposed second end defined by said second edges, said coreless roll first end having a first planar portion formed by the first edges of a first plurality of convolutions of sheet material and a first offset portion defined by the first edges of a second plurality of sheet material convolutions offset from the first edges of said first plurality of convolutions, said dispenser apparatus comprising, in combination:

a housing defining an interior and including a support engageable by the coreless roll first end to support said coreless roll of sheet material, said support defining a dispensing aperture through which sheet material from the coreless roll is pulled when dispensing said sheet material from the center of said roll; and stabilizing means on said housing for engaging said coreless roll and maintaining said coreless roll in a predetermined position relative to said dispensing aperture when said coreless roll is supported by said support and for resisting collapse of said coreless roll when said coreless roll nears depletion caused by dispensing of said sheet material through said dispensing aperture, said stabilizing means including a first stabilizing element at least partially registrable with said first offset portion and cooperable therewith to resist movement of said coreless roll relative to said stabilizing means and said dispensing aperture.

2. The apparatus according to claim 1 wherein said first stabilizing element comprises a rib projecting into said housing interior, said coreless roll first end offset portion comprising a channel, said rib being received in said channel when said support supports said coreless roll.

3. The apparatus according to claim 1 wherein said first stabilizing element comprises a recess formed in said housing, said coreless roll offset portion comprising a projection extending outwardly from said coreless roll first end planar portion and received within said recess when said support supports said coreless roll.

4. The apparatus according to claim 1 wherein said coreless roll second end has a second planar portion formed by edges of said first plurality of convolutions and a second offset portion defined by the second edges of said second plurality of sheet material convolutions offset from the second edges of said first plurality of convolutions, said stabilizing means including a second stabilizing element at least partially registrable with the second offset portion of said second end and cooperable therewith to resist movement of said coreless roll relative to said dispensing aperture.

5. The apparatus according to claim 4 wherein said housing includes an upper wall, said second stabilizing element located at said upper wall and at least partially registrable with the second offset portion and cooperable therewith to resist movement of said cordless roll relative to said dispensing aperture.

6. The apparatus according to claim 5 wherein said coreless roll has an outer periphery and wherein said stabilizing elements are in general alignment, said stabilizing elements being out of registration with said dispensing aperture and located closely adjacent to the outer periphery of said coreless roll.

7. The apparatus according to claim 5 wherein said housing includes two separable housing components, one of said housing components including said support and the other of said housing components including said upper wall, said support and said upper wall being separated a distance generally corresponding to the length of said coreless roll when assembled to form said housing.

8. The apparatus according to claim 6 wherein said stabilizing elements have a generally circular configuration.

9. Dispenser apparatus for dispensing sheet material from the center of a coreless roll of said sheet material having a first end and an opposed second end, said dispenser apparatus comprising, in combination:

housing means defining an interior and including a support engageable by the coreless roll first end to support said coreless roll of sheet material, said support defining a dispensing aperture through which sheet material from the coreless roll is pulled when dispensing said sheet material from the center of said roll; and stabilizing means for maintaining said coreless roll in a predetermined position relative to said dispensing aperture when said coreless roll is supported by said support and for resisting collapse of said coreless roll when said coreless roll nears depletion caused by dispensing of said sheet material through said dispensing aperture, at least said coreless roll first end having a planar portion formed by edges of a first plurality of convolutions of sheet material and an offset portion defined by edges of a second plurality of sheet material convolutions offset from the edges of said first plurality of convolutions, said stabilizing means including at least one stabilizing element at least partially registrable with said offset portion and cooperable therewith to resist movement of said coreless roll relative to said dispensing aperture, and said stabilizing element comprising a rib projecting upwardly from said support, said coreless roll offset portion comprising a channel, said rib being received in said channel when said support engages the coreless roll first end and supports said coreless roll.

10. Dispenser apparatus for dispensing sheet material from the center of a coreless roll of said sheet material having a first end and an opposed second end, said dispenser apparatus comprising, in combination:

housing means defining an interior and including a support engageable by the coreless roll first end to support said coreless roll of sheet material, said support defining a dispensing aperture through which sheet material from the coreless roll is pulled when dispensing said sheet material from the center of said roll; and stabilizing means for maintaining said coreless roll in a predetermined position relative to said dispensing aperture when said coreless roll is supported by said support and for resisting collapse of said coreless roll when said coreless roll nears depletion caused by dispensing of said sheet material through said dispensing aperture, at least said coreless roll first end having a planar portion formed by edges of a first plurality of convolutions of sheet material and an offset portion defined by edges of a second plurality of sheet material convolutions offset from the edges of said first plurality of convolutions, said stabilizing means including at least one stabilizing element at least partially registrable with said offset portion and cooperable therewith to resist movement of said coreless roll relative to said dispensing aperture, and said stabilizing element comprising a recess formed in said support, said coreless roll offset portion comprising a projection extending outwardly from said coreless roll planar portion and received within said recess when said support engages the coreless roll first end and supports said coreless roll.

* * * * *